US005385125A

United States Patent [19]

Oyaizu et al.

[11] Patent Number: 5,385,125

[45] Date of Patent: Jan. 31, 1995

[54] FOUR CYCLE ENGINE

[75] Inventors: Takeshi Oyaizu; Masahiko Iikura, both of Iwata, Japan

[73] Assignee: Yamaha Hatsudoki Kabushiki Kaisha, Iwata, Japan

[21] Appl. No.: 753,710

[22] Filed: Sep. 3, 1991

[30] Foreign Application Priority Data

Sep. 4, 1990 [JP] Japan ..... 2-235268
Sep. 26, 1990 [JP] Japan ..... 2-257877

[51] Int. Cl.[6] ..... F01L 1/02

[52] U.S. Cl. ..... 123/90.27; 123/90.31; 123/90.48; 123/90.67; 123/54.4

[58] Field of Search ..... 123/55 VF, 55 VS, 55 VE, 123/41.74, 41.82 R, 90.27, 90.31, 90.48, 90.51, 193.3, 193.5, 90.65, 90.67, 432

[56] References Cited

U.S. PATENT DOCUMENTS 4,553,473 11/1985 Ichida et al. ..... 123/193.5
4,615,309 10/1986 Yoshikawa ..... 123/90.27
4,617,882 10/1986 Matsumoto ..... 123/90.31
4,745,888 5/1988 Kapp ..... 123/90.51

FOREIGN PATENT DOCUMENTS 3724495 2/1989 Germany .

OTHER PUBLICATIONS

Patent Abstract of Japan vol. 015, No. 497, Dec. 16, 1991 & JP-A-03 217 606, Sep. 25, 1991.
Patent abstract of Japan vol. 014, No. 355 Jul. 31, 1990 & JP-A-2 123 207 May 10, 1990.
Patent Abstract of Japan vol. 011, No. 323, Oct. 21, 1987 & JP-A-62 107 211 May 18, 1987.

*Primary Examiner*—Noah P. Kamen
*Attorney, Agent, or Firm*—Knobbe, Martens, Olson & Bear

[57] ABSTRACT

A multiple valve internal combustion engine and specifically a cylinder head and valve operating mechanism therefore. The cylinder head is formed from a two part construction and an arrangement is provided for operating the valves that permits a maximum volume cooling jacket to be formed on the exhaust side of the cylinder head. The camshaft and tappet mechanism for operating the valves is formed in a second cylinder head portion and a port extends through both cylinder head portions for serving the combustion chamber of the cylinder head. Various cam drive arrangement including either gear or chain drives are also disclosed.

43 Claims, 7 Drawing Sheets

FOUR CYCLE ENGINE

BACKGROUND OF THE INVENTION

This is invention relates to a four cycle engine and more particularly to an improved cooling, valve operating, and air intake structure for the cylinder head of such an engine.

The use of overhead valves is well known in four cycle engine to improve their efficiency and performance. In fact, it is now the practice to employ multiple intake and exhaust valves for the purpose of performance and efficiency improvement. In one popular valve and port arrangement for such engines, there are provided a greater number of intake valves than exhaust valves. In a specific form, there are employed three intake valves and two exhaust valves. Where there are a greater number of one type of valves than the other, it is normally the practice to use larger head diameters on the lesser number of valves and a greater lift therefore. However, this gives rise to certain difficulties.

When one set of the valves has a larger diameter and greater lift, stiffer springs must be employed for closing the valves and longer springs must be employed so as to permit the greater degree of lift. Since it is normally the practice to use symmetrical camshaft locations for operating the different valves, this means that both camshafts become raised relative to the cylinder head and the overall height of the engine becomes large. On the other hand, if there is an attempt to make the engine more compact by compressing the height of the cylinder head on the side where the lesser number of valves are employed, this gives rise to a different problem. When this is done, then the cooling jacket around the lesser number of valves can be restricted. This is a particular problem since the lesser number of valves are generally the exhaust valves and a greater degree of cooling is required for this side of the cylinder head.

It is, therefore, a principal object to this invention to provide an improved cylinder head arrangement that accommodates different number of intake and exhaust valves and still provides adequate cooling without excessive cylinder head height.

It is a further object to this invention to provide an improved cylinder head arrangement for a multi-valve engine wherein a greater height cooling jacket may be provided on one side of the engine than the other without having the overall engine height become excessively large.

It is a further object to this invention to provide a valve operating structure for the cylinder head of an engine which permits the use of different numbers of intake and exhaust valves and tailors the valve spring and tappet operating mechanism for each valve to suit its specific needs without providing unduly large cylinder head or one that does not have adequate cooling.

It is generally the practice, as afore suggested, to employ separate intake and exhaust camshafts for the valves of an overhead valve, multiple valve engine. Where, however, the engine employs different number of intake and exhaust valves, the camshafts may not be positioned symmetrically. This can give rise to problems in properly driving the camshafts and orienting the overall engine construction.

It is, therefore, a still further object to this invention to provide an improved camshaft drive arrangement for an internal combustion engine.

Where multiple valves are employed, the placement of the valves and their valve actuators also presents some design problems. When overhead camshafts are employed, normally thimble tappets are interposed between the camshafts and the valve stems for their actuation. However, when multiple valves are employed then the supporting structure for these tappets in the cylinder head assembly can present some problems. That is, if a number of bores are positioned closely adjacent to each other, the intervening area between the bores may be weak. This is a particular problem when light alloy cylinder head material is employed.

It is, therefore, a still further object to this invention to provide an improved cylinder head arrangement that facilitates the use of multiple tappets positioned close to each other and yet supported by a relatively strong structure.

In one form of cylinder head construction particularly useful with multiple valve engines, the cylinder head is actually divided into two components. These are a lower head portion and an upper cam carrier portion. The cam carrier portion carries the camshafts and also the tappets that operate the valves. Where such an arrangement is employed, however, this gives rise to the difficulties in porting the cylinder head. That is, the ports must, with prior art constructions, be disposed so that they only extended through the lower cylinder head portion. This substantially compromises the porting system.

It is, therefore, a still further object to this invention to provide an improved porting arrangement for a multiple valve, two piece cylinder head construction for an internal combustion engine.

SUMMARY OF THE INVENTION

A first feature of this invention is adapted to be embodied in a cylinder head arrangement for a multiple valve, internal combustion engine. This cylinder head has a lower surface defining in part a combustion chamber and a plurality of poppet type exhaust valves are supported on one side of the cylinder head for reciprocation about acute angles relative to a perpendicular central plane passing through the cylinder head. A plurality of poppet type intake valves are supported on the other side of the cylinder head for reciprocation about respective acute angles relative to the perpendicular plane. Coil spring means encircle the stems of the poppet valves and are engaged with an upper surface of the cylinder head for urging each of the poppet valves to its close position. A cooling jacket is formed in the cylinder head for receiving a liquid coolant. The cylinder head upper surface engaged by the coil springs associated with the exhaust valves, is spaced farther from the cylinder head lower surface then the upper surface of the cylinder head engaged by the coil springs and associated with the intake valves for providing a greater volume of cooling jacket on the exhaust side of the cylinder head.

Another feature of the invention is adapted to embodied in a valve arrangement for a multiple valve, overhead valve internal combustion engine comprises a cylinder head defining in part a combustion chamber. A plurality of first poppet valves are provided on one side of the cylinder head. A plurality of second poppet valves are provided on the other side of the cylinder head. One of the plurality of poppet valves, comprises intake valves and the other of the poppet valves comprise exhaust valves and there are more of the first valves than of the second valves. A first series of coil springs are provided for urging the first poppet valves to their closed position. A plurality of first tappets are provided for operating the valves of the first series. The diameter of the first coil springs is substantially equal to the diameter of the first tappets. A plurality of second coil springs are associated with each of the second valves for urging the second valves to their closed positions. A plurality of second tappets are associated with each of the second valves for operating the second valves. The diameter of the second coil springs is less than the diameter of the second tappets and a portion of the second springs are telescoped into the second tappets.

Another feature of this invention is adapted to be embodied in a cam driving arrangement for a twin overhead cam internal combustion engine. The engine has a cylinder head with a pair of camshafts journalled in the cylinder head for rotation about respective axes on oppisite sides of a center plane passing through the center of the cylinder head. One camshaft is offset from the center plane by a greater distance than the offset of the axis of the other camshaft. A driving shaft is journalled for rotation relative to the cylinder head about an axis that is offset to that one side of the plane and drives each of the camshafts.

Another feature of the invention is adapted to be embodied in a cylinder head construction for a multiple valve, internal combustion engine. The cylinder head has a plurality of poppet valves disposed on one of its sides and is formed with an enlarged opening. An insert is provided in this opening and defines a plurality of bores for slideably supporting tappets for operating the valves.

Yet another feature of the invention is adapted to be embodied in a cylinder head construction for an overhead, valve internal combustion engine. The cylinder head comprises a lower cylinder head piece forming the major portion of the cylinder head and an upper, cam carrier piece. A plurality of ports are formed in the cylinder head and extend from a combustion chamber formed in the lower piece to an opening formed in the upper piece.

DETAILED DESCRIPTION OF THE PREFERRED EMBODIMENT OF THE INVENTION

Figure 1:
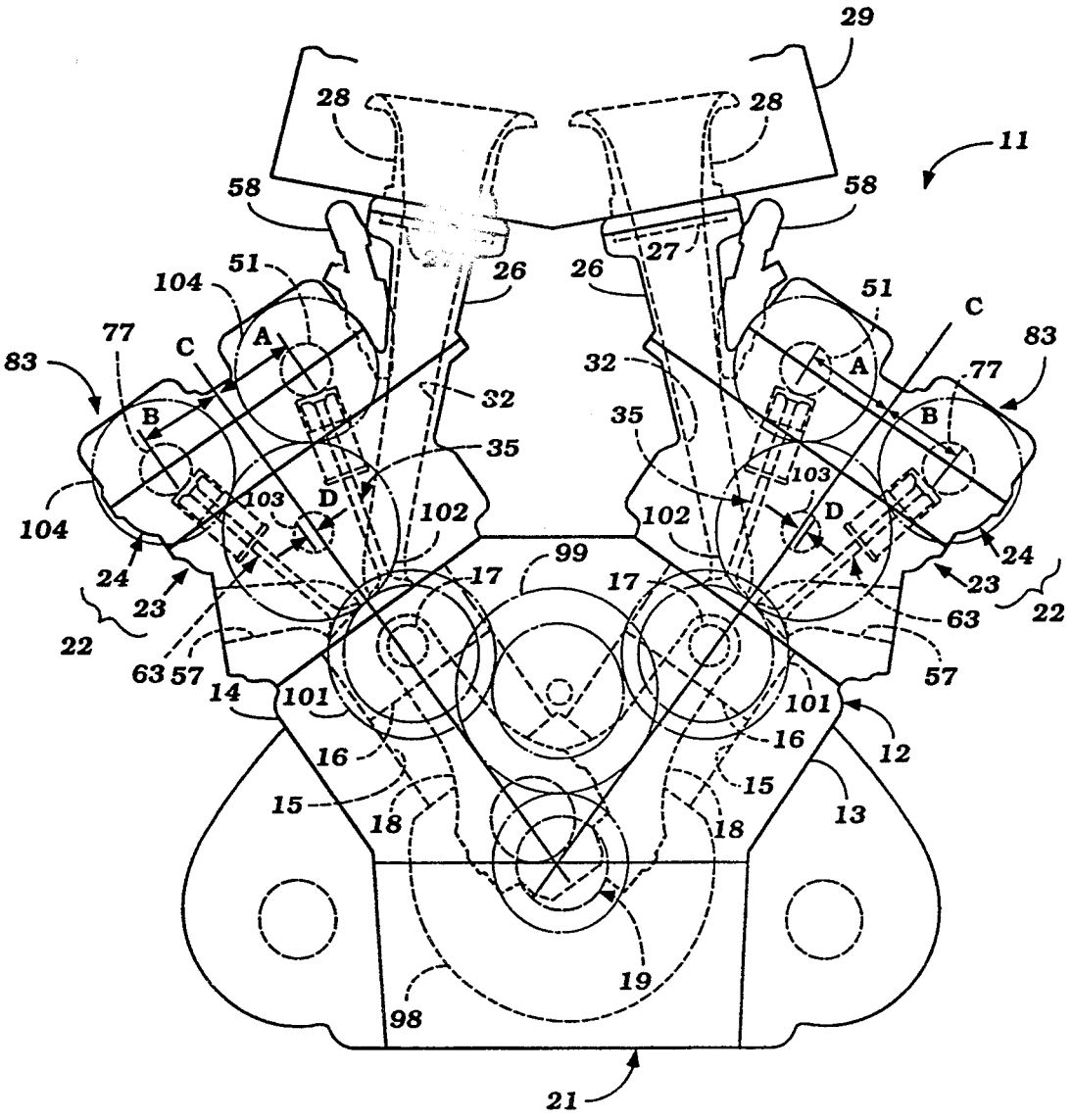
FIG. 1 is a front elevational view of an internal combustion engine constructed in accordance with an embodiment of the invention.
Figure 2:
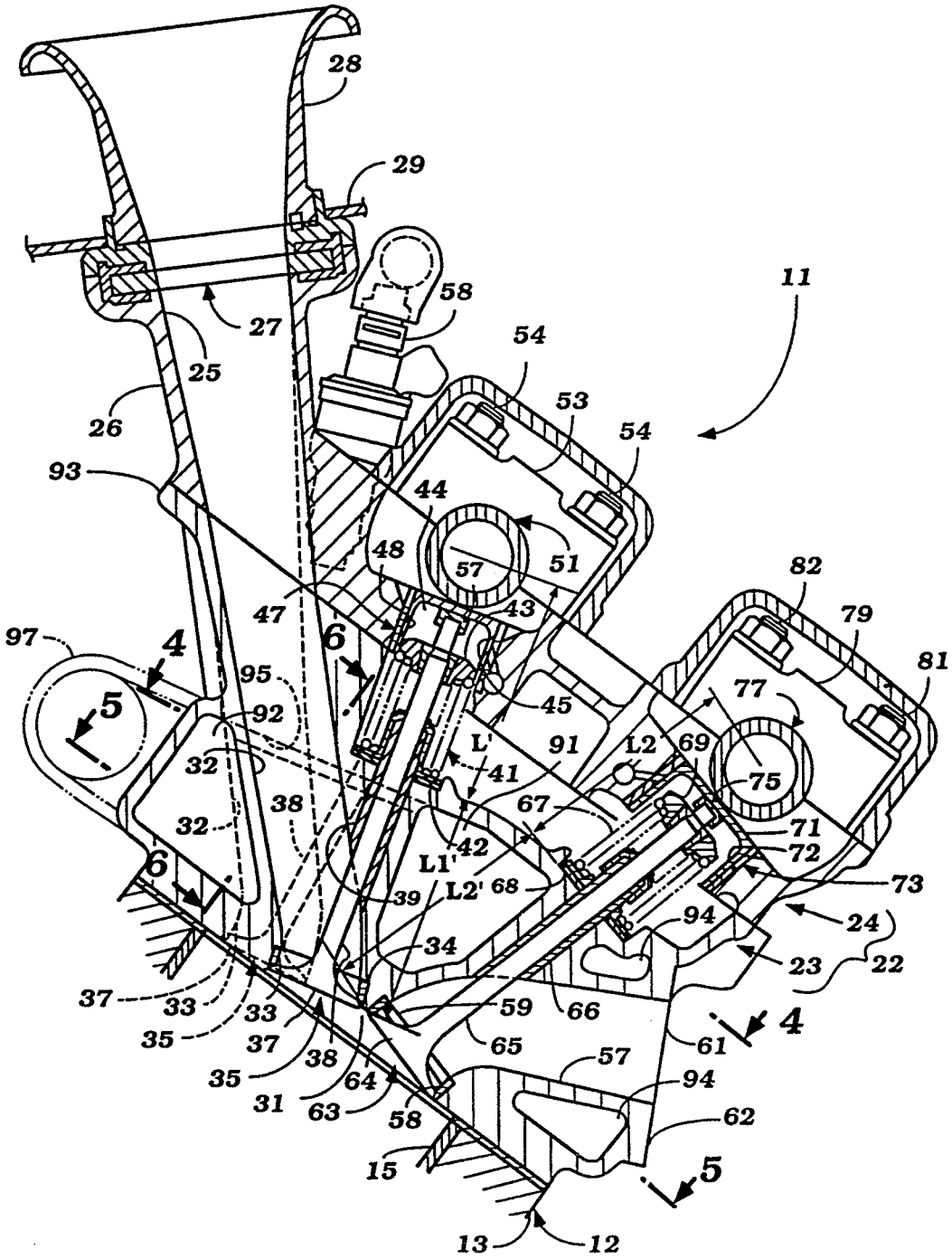
FIG. 2 is an enlarged cross-sectional view taken through the cylinder head and upper portion of the cylinder bore of the right hand bank of the engine.

Referring now in detail to the drawings and initially primarily to FIG. 1, a water cooled, four cycle internal combustion constructed in accordance with an embodiment of the invention is depicted and is identified generally by the reference numeral 11. In the illustrated embodiment, the engine 11 is depicted as being of the V-type although is should be readily apparent to those skilled in the art that the invention can be practiced with engines have other than a V-type configuration.

The engine 11 includes a cylinder block 12 having a pair of inclined cylinder banks 13 and 14, each of which is formed with one or more cylinder bores 15. Pistons 16 are supported for reciprocation within the cylinder bores 15 and are connected by means of piston pins 17 to the small end of connecting rods 18 in a well known manner. The lower ends of the connecting rods 18 are journalled, in paired fashion, on journal portions of a crankshaft, indicated generally by the reference numeral 19.

The crankshaft 19 is journalled for rotation in a well known manner and is contained within a crankcase assembly formed by the lower portion of the cylinder block 12 and a crankcase 21 which is affixed to the cylinder block 12 in a known manner. Since the invention deals primarily with the cylinder head assembly for the engine 11, further description of the cylinder block 12, components contained therein and the crankcase 21 are not believed to be necessary to understand the invention. For that reason, further description of these components will not be included.

Referring now additionally to FIGS. 2 through 7, a cylinder head assembly 22 is affixed to each of the cylinder banks 13 and 14 in a suitable manner. Each cylinder head assembly 22 is comprised of a two part construction consisting of a lower or main head portion 23 and an upper, cam carrier portion 24. The portions 23 and 24 may be affixed to each other in a suitable manner.

The center or valley side of each cylinder head assembly 22 comprises the intake side and there is provided a siamese type of intake passage on this side of each cylinder head assembly 22 that is comprised of a generally oval shaped intake opening 25 which is formed in an inner wall 26 of the cam carrier portion 24. A slide type throttle valve assembly 27 is slideably supported in this intake portion 25 in a suitable manner and is served by an inlet air trumpet 28 that extends into an air box or plenum chamber 29 which receives atmospheric air in a suitable manner.

From the oval inlet opening 25, the intake port extends downwardly toward a combustion chamber 31 formed by individual recesses in the lower face of the cylinder head assembly 22 and specifically the head portion 23. The intake port divides into individual intake passages 32 each of which terminates at a respective intake port 33 formed by a valve insert 34 pressed or cast into the cylinder head portion 23 in the combustion chamber 31.

A respective intake valve 35 controls the communication of each intake port 33 with the combustion chamber 31. The intake valves 35, there being three for each combustion chamber 31 or cylinder 15, are disposed as generally described in U.S. Pat. No. 4,660,529, entitled "Four-Cycle Engine",l issued Apr. 28, 1987 in the name of Masaaki Yoshikawa, and assigned to the assignee hereof. Basically, the intake valves 35 are supported for reciprocation, in a manner to be described, about respective axes that inclined at acute angles to a plane containing the axis of the cylinder bore 15 and extending perpendicularly to the plane of FIG. 2. One, the center, of the intake valves 35 is disposed at a lesser acute angle then the remaining two intake valves 35, which generally are reciprocal along axes that are parallel to each other and lie within a common plane. Of course, other types of relationships may be employed and the invention can be utilized in conjunction with engines having other than three intake valves. However, the invention has particular utility in engines having three or more intake valves wherein the intake passages are defined in part by a common internal wall of the cylinder head assembly, this wall being identified generally by the reference numeral 36 in the figures.

Each of the intake valves 35 is of the poppet type and includes a head portion 37 which cooperates with the respective valve seat 33 for controlling the communication of the combustion chamber 31 with the intake ports formed by the portions 32 and 25. In addition, each valve 35 has a stem portion 38 which is slideably supported within a respective valve guide 39 that is pressed or cast into the cylinder head assembly 22 and specifically the main cylinder head portion 23.

A spring assembly, indicated generally by the reference numeral 41 and comprised of a pair of concentric coil springs is provided for urging each intake valve 35 to its closed portion. The spring assembly 41 bears against a bearing surface 43 provided by an upper surface of the cylinder head portion 23 and a spring retainer 43 that is affixed in a known manner, as by means of a keeper to the upper portion of the respective valve stem 38.

The intakes valves 35 are each operated by a respective tappet 44 which is slideably supported, in a manner to be described, in the cam carrier portion 24 of the cylinder head assembly 22. It should be noted that the outer diameter of the intake valve spring assembly 41 is substantially equal to the diameter of the tappet 44 and thus, only the retainer 43 extends into an internal bore 45 of the tappet 44.

Figure 3:
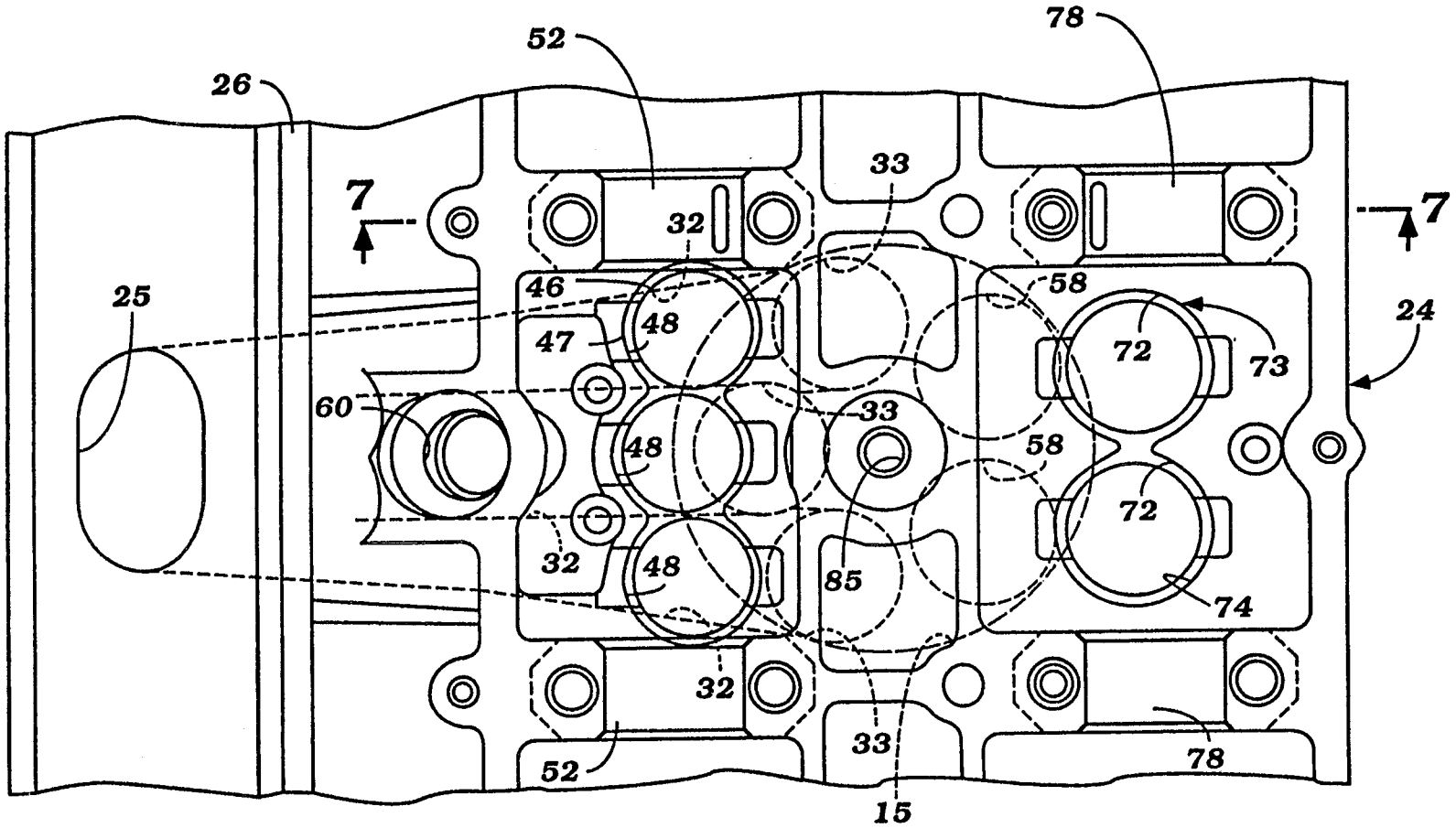
FIG. 3 is a top plan view of a portion of the right hand bank cylinder head assembly with the cam shafts, cam covers and cam bearing caps removed.

It should be noted from FIG. 3 that the cylinder head portion 24 is provided with a single opening 46 that receives a common insert piece 47 that defines bores 48 in which the respective tappets 44 reciprocate. This permits the tappets 44 to be positioned quite close to each other and still permits a high strength for the cylinder head portion 24. The cylinder head portions 23 and 24 are primarily formed from a light alloy material such a aluminum alloy. If the tappet bores were formed directly in the cam carrier portion 24, the area between the tappet bores would be very small and due to the relatively low strength of aluminum, problems could occur. However, by providing the large opening 46 and the common insert piece 47 it is possible to make the insert piece 47 from a more wear resistance stronger material so as to permit this close tappet bore spacing.

Figure 7:
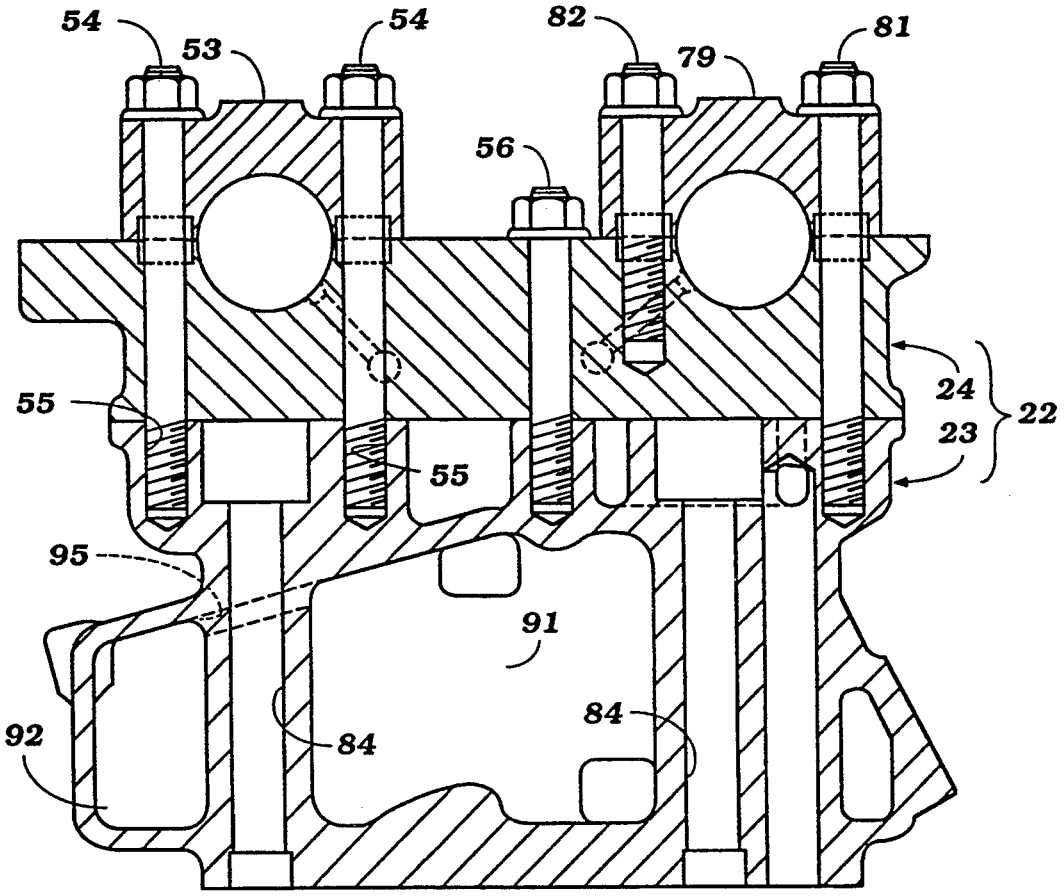
FIG. 7 is an enlarged cross-sectional view taken along the line 7—7 of FIG. 3.

An intake cam shaft 51 is rotatably journalled within the cam carrier portion 24 of the cylinder head assembly 22 by means of bearing surfaces 52 formed on opposite sides of the tappet supporting insert 47. Bearing caps 53 are affixed to the cam carrier portion 22 for each bearing surface 52 by means of studs 54 which extend through the bearing caps 53, cam carrier portion 24 and are threaded into tapped openings 55 formed in the main cylinder head portion 23 (FIG. 7). This provides a portion of the means by which the cylinder head portion 24 and 23 are affixed to each other. Further studs 56 also secure directly the portions 24 and 23 to each other and do not cooperate with the bearing caps 53.

The intake cam shaft 51 has respective lobes that cooperate with the tappets 44 so as to operate the intake valves 35 in a known manner. Adjusting shims 57 are interposed between the ends of the valves stems 38 and the tappets 44 for clearance adjustment. The intake cam shafts 51 are driven in a manner which will be described.

Fuel injectors 58 are mounted in the cylinder head assembly 22 in pocket 60 on the intake side thereof and spray fuel into the intake passages formed by the inlet portions 25 and portions 32. The fuel injectors 58 are operated and controlled in suitable manner.

Figure 4:
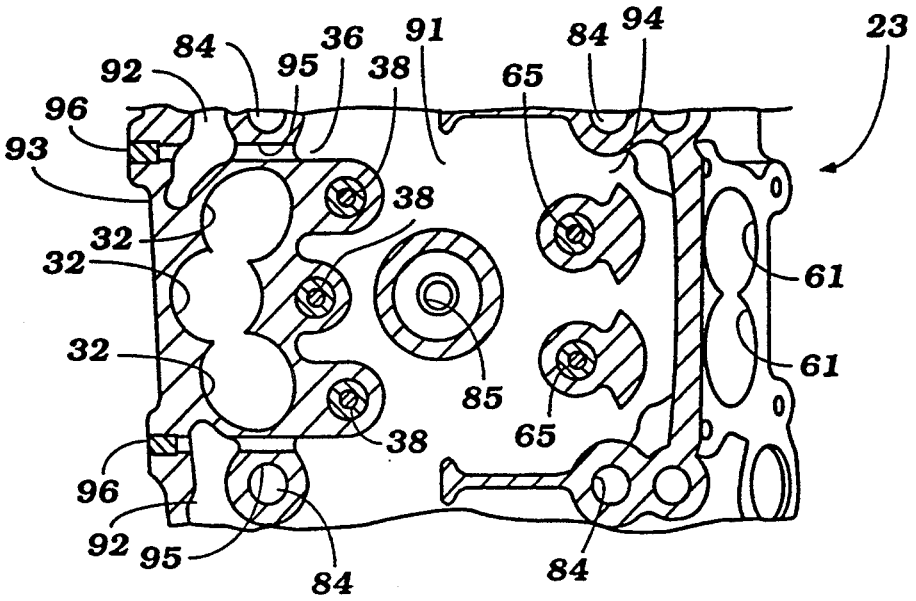
FIG. 4 is a cross-sectional view taken along the line 4—4 of FIG. 2.

A pair of exhaust passages 59 extend from exhaust ports 58 formed by valve inserts 59 through the exhaust side of the engine and terminate in outlet openings 61. The openings 61 are partially siamesed as shown in FIG. 4 and formed in a side surface 62 of the cylinder head portion 23. In the illustrated embodiment, there are two exhaust passages 57 for each combustion chamber 31. Of course, the invention can be employed in conjunction with a different number of exhaust passages but the invention has particular utility where there are a lesser number of exhaust passages than intake passages.

Poppet type exhaust valves 63 have head portions 64 that cooperate with the exhaust ports 58 for controlling the flow of exhaust gases from the combustion chamber 31. As described in aforenoted U.S. Pat. No. 4,660,529, the exhaust valves 63 may supported for reciprocation along parallel axes which lie at a common plane that is disposed at an acute angle to the aforenoted plane containing the axis of the cylinder bore 15 and which acute angle is less than the acute angle of the side intake valves 35 and greater than the acute angle of the center intake valve 35. It should be noted that the heads of the exhaust valves 64 lie on the exhaust side of the aforenoted plane when the exhaust valves 63 are closed while the heads 37 of the intake valves 35 lie substantially on the other side of this plane. The heads of the side intake valves, however, extends slightly over this plane.

The exhaust valves 63 have stem portions 65 that are slideably supported within valve guides 66 that are pressed or cast into the cylinder head portion 23. The exhaust valves 63 are urged to their closed positions by means of a spring assembly 67 that includes a pair of concentric coil springs. The spring assembly 67 bears against a bearing surface 68 formed on the upper side of the cylinder head portion 23. The other ends of the springs of the spring assembly 67 bear against a keeper retainer assembly 69 that is affixed to the upper end of the valve stems 65.

A bucket type tappet assembly 71 is provided for operating each of the exhaust valves 63. Each bucket tappet 71 is slideably supported within a respective bore 72 formed by a common insert piece 73 that is inserted into the cam carrier 24 and specifically an opening 74 having generally the shape of a figure eight. This insert piece 73 is formed from a stronger more wear resistant material than the cam carrier 24. This construction, like that associated with the intake valve tappets 44, provides a stronger head assembly and yet permits close placement of the exhaust tappets 71 to each other.

It should be noted that the diameter of the exhaust valve spring assembly 68 is smaller than the diameter of the bucket tappets 71 and, accordingly, the keeper 69 extends to the upper end of the bucket tappets 71. Adjusting shims 75 are interposed between the ends of the valve stems 65 and the bucket tappets 71 for clearance adjustment.

Figure 5:
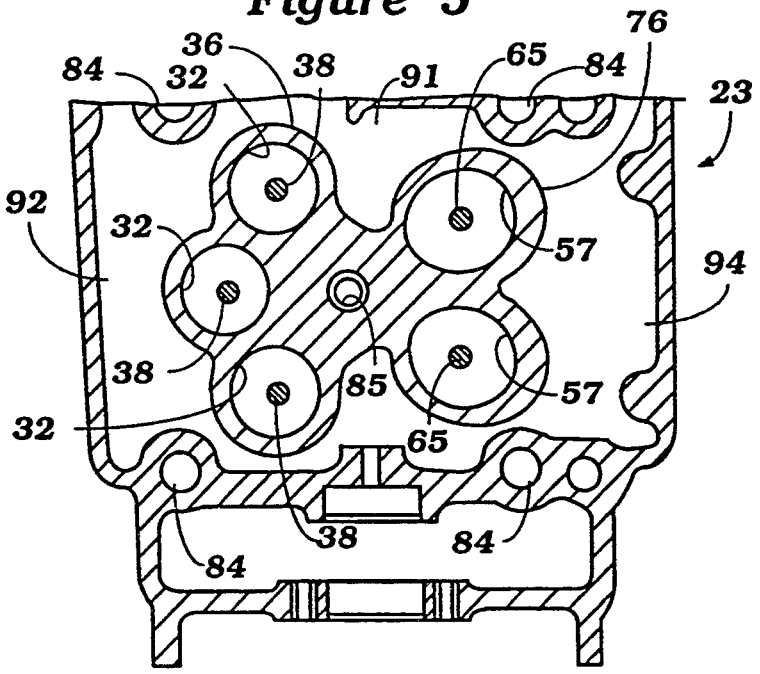
FIG. 5 is a cross-sectional view taken along the line 5—5 of FIG. 2.

It should be noted that the exhaust passages 57 are formed at least in part by a common wall which appears in FIG. 5 and is identified generally by the reference numeral 76.

The exhaust valves 63 and specifically their actuating tappets 71 are operated by means of an exhaust cam shaft 77. The exhaust cam shaft 77, like the intake cam shaft 55 is rotatably journalled within a pair of bearing surfaces 78 (FIG. 3) formed on opposite sides of each of the tappets supporting inserts 73. Bearing caps 79 are affixed thereto by means of longer studs 81 which, like the intake cam shaft studs 54, extend through the cam carrier 24 and are threaded into the cylinder head main portion 23 (FIG. 7). In addition, shorter studs 82 extend through the bearing caps 79 and are threaded into tapped openings in the cam carrier portion 24 so as to complete the attachment of the bearing caps 79 to the cylinder head assembly.

The exhaust cam shaft 77 is driven in a manner which will be described. The intake and exhaust cam shafts 51 and 77 for each cylinder head assembly 22 are enclosed within a cam cover 83 that is affixed to the cylinder head assembly 22 in any suitable manner.

It has been noted that there are less exhaust valves 63 than intake valves 35 for each cylinder. Because of this, the exhaust valves 63 have head portions 64 that are larger in diameter than the head portions 33 of the intake valves 35. In addition, a greater amount of lift is provided for the exhaust valves 63 than for the intake valves 35. This necessitates the use of stiffer springs for the exhaust valves than for the intake valves. Also, the spring length for the exhaust valves should be greater than the spring length for the intake valves. It is desireable, however, to keep the rotational axes of the intake and exhaust camshafts 51 and 77, approximately the same distance above the cylinder head axis. The relative diameters between the intake valve coil springs 45 and their actuating tappets 44 and the exhaust coil springs 67 and their actuating tappets 71 permits this to be achieved. As may be seen in FIG. 2, the distance $L_2$ from the axis of rotation of the exhaust camshaft 77 to the cylinder head bearing surface 68 is smaller than the corresponding distance $L^1$ between the axis of rotation of the intake camshaft 51 and its cylinder head bearing surface 42. This is permitted by the spring and tappet relationship as thus far described. The distance $L^{2'}$ from the exhaust valve seating surface 68 to the lower face of the heads 64 of the exhaust valves 63 is greater than the corresponding distance $L^{1'}$ of the intake valves 35. This achieves the result that the exhaust and intake camshafts 77 and 51, have their rotational axes disposed at approximately the same height relative to the lower cylinder head surface while, at the same time, maintaining sufficient length for the exhaust spring 67 to accommodate the higher lift and, at the same time, provide the greater cooling jacket on this side of the cylinder head.

Figure 6:
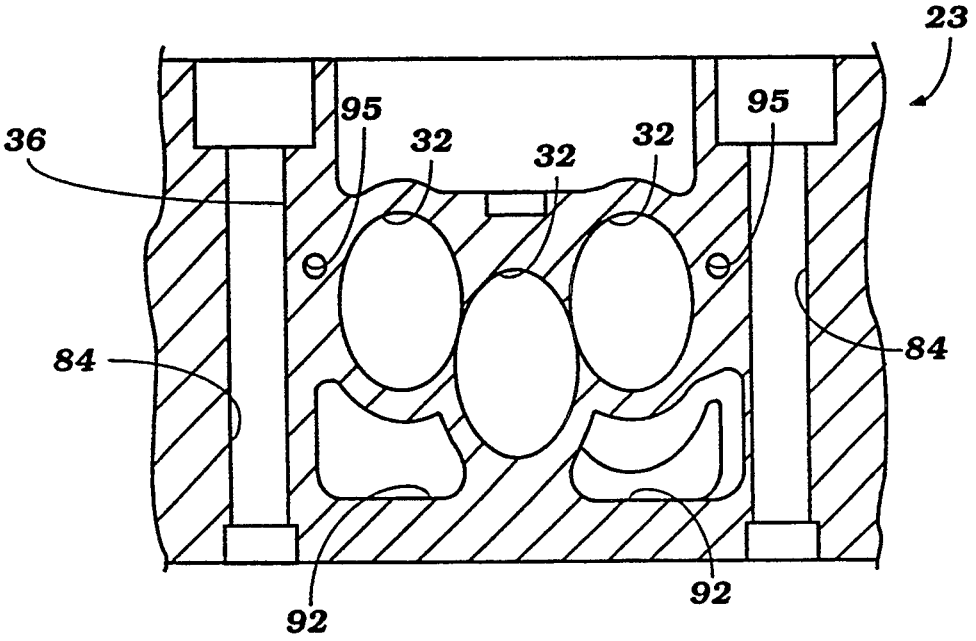
FIG. 6 is a cross-sectional view taken along the line 6—6 of FIG. 2.

As may be seen in FIGS. 4 through 6, the internal walls 36 and 76, which form the intake and exhaust ports are formed with bored openings 84 that are adapted to receive fasteners for securing the cylinder head assembly 22 to the cylinder block 12. In addition, these walls merge at a central portion of the cylinder head portion 23 adjacent the combustion chamber 31 and define a spark plug receiving opening 85 which is generally centrally disposed in the combustion chamber for receiving a spark plug (not shown) for each cylinder to fire the charge therein in a well known manner.

The engine 11 is water cooled and to this end the cylinder block 12 is provided with a cooling jacket (not shown) through which water is circulated by a coolant pump, which is also not shown. Each cylinder head assembly 22 is provided with a cooling jacket that is defined by three portions. These portions comprise a central portion 91 which is defined generally adjacent the combustion chamber 31 and between the intake wall 36 and the exhaust wall 76. In addition, there is provided an intake cooling jacket portion 92 that is formed on the valley side of the cylinder head assembly 22 and primarily defined by the wall 36 and the outer surface or outer wall 93 of the cylinder head portion 23. There is further provided an exhaust jacket portion 94 that is defined between the wall portion 62 of the cylinder head portion 23 and the exhaust wall 76.

Because of the fact that the exhaust spring bearing surface 68 is disposed at a higher level than the intake spring bearing surface 42, the exhaust jacket portion 94 is higher than the intake portion 92. This insures better cooling of the more highly heated exhaust side of the cylinder head assembly 22. For this same reason, cooling water is delivered to the cylinder head cooling jacket from the cylinder block cooling jacket first through the exhaust cooling jacket portion 94 through passages (not shown).

This cooling water then flows to the central cylinder head cooling jacket portion 91 and it will be seen that the wall 76 is substantially interrupted due to the fact that there are only two exhaust passages 57 so as to insure good coolant flow. However, the communication with the intake cooling jacket portion 92 is more restricted due to the fact that there are more intake passages than exhaust passages. Furthermore, since the cylinder head assembly 22 is inclined due to the V shape of the engine, the upper portion of the intake cooling jacket portion 32 can form air pockets which could adversely effect the cooling.

In order to provide good water communication and air purging, communication passageways, indicated by the reference numerals 95 are formed in the wall 36. In accordance with a feature of the invention, the passageways 95 may be conveniently formed by drilling them from the exterior surface 93 of the cylinder head portion 23 as may be best seen in FIG. 4. The outer wall 93 of the cylinder head portion 23 will be drilled, but this drilled opening is then closed by plugs 96 so as to maintain integrity of the cooling jacket. However, because of the drilled arrangement it is possible to conveniently form the water flow passages which will not only circulate the coolant from the cylinder head cooling jacket central portion 91 to the intake portion cooling jacket 92 but which will also permit air to be purged from the system.

A discharge port 97 is formed at one end of the cylinder head portion 23 and communicates with the intake side cooling jacket portion 92 for discharge of the coolant from the cylinder heads 22.

As may be seen in FIG. 5, at the lower portion of the cylinder head assembly 22, coolant may easily flow from the central portion 91 to the intake portion 92 around the outer periphery of the wall 36. It is only at the upper portion where the drilled passages 95 are provided that a problem would occur but for the passages 95.

The drive for the cam shafts 51 and 57 of each cylinder bank will now be described by reference to FIG. 1. It should be noted that due to the placement of the exhaust valves 63 and intake valves 35 and specifically their angular orientation, the axis of rotation of the intake camshaft 51 is closer to a plane C containing the axis of the cylinder bore 15 and the axis of rotation of the crankshaft 19 (Distance A) than the axis of rotation of the exhaust camshaft 77 to this plane (Distance B). The significance of this will follow.

The camshaft drive is comprised of a gear train that is a comprised of a first drive gear 98 that is affixed to the crankshaft 91 and which meshes with an intermediate drive gear 99 rotatably journalled at one end of the cylinder block 12 in appropriate manner. The gear 99 meshes with a pair of gears 101 journalled on opposite sides of the cylinder block 12 adjacent the banks 13 and 14. These gears 101 mesh with gears 102 journalled on shafts 103 that are supported in the cylinder head portions 23.

Since the exhaust and intakes camshafts axes of rotation are offset from the plane C by different distances, the axis of rotation of the gears 102 and the shafts 103 are offset a distance D from the plane C toward the exhaust camshafts, the distance D equals B−A. This permits the meshing relationship between the gears to be well established. The gears 102 mesh with gears 104 fixed to the intake and exhaust cam shafts 51 and 77 of the respective cylinder head assemblies. This gear train comprised of the gears 98, 99, 101, 102 and 104 drives the cam shafts 51 and 77 at one half crankshaft speed, for reasons well known in this art.

Figure 8:
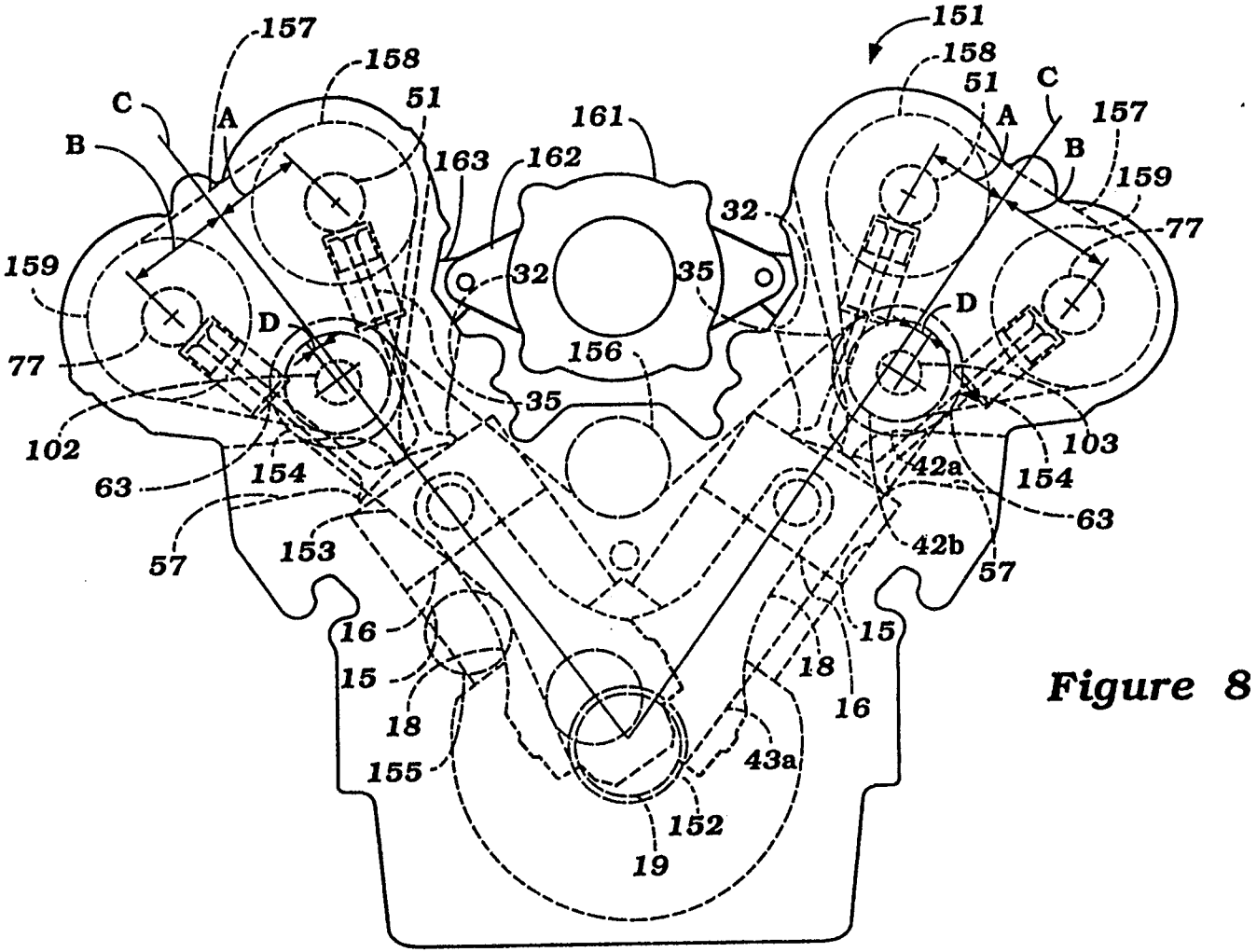
FIG. 8 is a front elevational view, in part similar to FIG. 1, and shows another embodiment of the invention.

In the embodiment of FIGS. 1 through 7, the intake and exhaust camshafts 51 and 77, were driven by a gear train. FIG. 8 shows another embodiment of the invention wherein the intake and exhaust cam shafts are driven by a chain drive arrangement rather than by a gear train. Because this is the only difference from the previously described embodiment, components which are the same in this embodiment, as the previously described embodiment have been identified by the same reference numerals and will not be described again, except in so far as is necessary to understand the construction and operation of this embodiment.

The engine in this embodiment, as identified generally by the reference numeral 151 and rather than a gear a sprocket 152 is affixed to the crankshaft 19. The sprocket 152 drives a first chain 153 which, in turn, drives sprockets 154 that are journalled upon the intermediate shafts 103. This intermediate shafts 103 are offset the distance D relative to the plane C as with the previously described embodiment. The distance D is equal to the difference between the distances B and the distance A. A chain tensioner 155 engages one side of the chain 153 to maintain its tension and an idler sprocket 156 is positioned in the valley of the V.

A second chain, indicated by the reference numeral 157 is provided on each cylinder head and meshes with another sprocket coaxial with and driven by the sprocket 154 and with sprockets 158 and 159 affixed to the intake and exhaust camshafts 51 and 77, respectively. Again, the sprocket ratio is such that the camshafts will rotate at one half engine speed.

In this embodiment, there is also shown an alternator 161 having mounting brackets 162 that affixed to lugs 163 formed on opposite sides of the cylinder heads.

It should be readily apparent from the foregoing description, that the described construction provides an extremely effective valve operating and cylinder head arrangement for a multiple valve, double overhead cam shaft internal combustion engine that permits a compact cylinder head assembly, good valve operation and adequate and complete cooling of the cylinder head. In addition, an improved arrangement is disclosed for supporting the thimble tappet and for driving the camshafts as well as providing effective porting in a two part cylinder head. Of course, the foregoing description is that of preferred embodiments of the invention and various changes and modifications may be made without departing from the spirit and scope of the invention, as defined by the appended claims.

We claim:

1. A cylinder head arrangement for a multi-valve internal combustion engine, said cylinder head having a lower surface defining in part a combustion chamber with an associated cylinder bore, a plurality of exhaust poppet valves supported on one side of said cylinder head for reciprocation about an acute angle relative to a central plane containing the axis of said cylinder bore, a plurality of intake poppet valves supported on the other side of said cylinder head for reciprocation about acute angles relative to said central plane, coil spring means surrounding the stems of said poppet valves and engaged with a respective upper surfaces of said cylinder head for urging each of said poppet valves to its closed position, a cooling jacket formed in said cylinder head for receiving a liquid coolant, the cylinder head upper surface engaged by the coil spring means associated with said exhaust valves being spaced further from said cylinder head lower surface than the upper surface of said cylinder head engaged by the coil springs associated with said intake valves for providing a greater volume of cooling jacket on the exhaust of said cylinder head than on the intake side of said cylinder head.

2. A cylinder head arrangement as set forth in claim 1 wherein the stems of the poppet valves have approximately the same length.

3. A cylinder head arrangement as set forth in claim 1 wherein the coil springs associated with the intake valves are engaged with the stems of the intake valves at a position closer to the surface of the cylinder head engaged thereby than the corresponding engagement between the coil springs with the stems of the exhaust valves.

4. A cylinder head arrangement as set forth in claim 3 wherein the stems of the poppet valves have approximately the same length.

5. A cylinder head arrangement as set forth in claim 4 further including a plurality of tappets each cooperating with a respective one of the valve stems for actuating the valve stems.

6. A cylinder head arrangement as set forth in claim 5 wherein the tappets associated with the intake valves are all operated by an intake camshaft and the tappets associated with the exhaust valves are all operated by an exhaust camshaft.

7. A cylinder head arrangement as set forth in claim 6 wherein the axes of rotation of the intake and exhaust camshafts lie at approximately the same distance above the cylinder head lower surface.

8. A cylinder head arrangement as set forth in claim 5 wherein the coil spring means associated with the intake valves have approximately the same diameter as the tappets associated with the intake valves.

9. A cylinder head arrangement as set forth in claim 8 wherein the intake valves tappets are disposed above the upper ends of the intake coil spring means.

10. A cylinder head arrangement as set forth in claim 9 wherein the coil springs associated with the exhaust valves have a smaller diameter than the tappets associated with the exhaust valves.

11. A cylinder head arrangement as set forth in claim 10 wherein the exhaust valve tappets telescopically receive the upper ends of the exhaust valve springs.

12. A cylinder head arrangement as set forth in claim 5 wherein the coil springs associated with the exhaust valves have a smaller diameter than the tappets associated with the exhaust valves.

13. A cylinder head arrangement as set forth in claim 12 wherein the exhaust valve tappets telescopicly receive the upper ends of the exhaust valve springs.

14. A cylinder head arrangement as set forth in claim 1 further including a plurality of tappets each cooperating with a respective one of the valve stems for actuating the valve stems.

15. A cylinder head arrangement as set forth in claim 14 wherein the coil spring means associated with the intake valves have approximately the same diameter as the tappets associated with the intake valves.

16. A cylinder head arrangement as set forth in claim 15 wherein the intake valves tappets are disposed above the upper ends of the intake coil spring means.

17. A cylinder head arrangement as set forth in claim 16 wherein the coil springs associated with the exhaust valves have a smaller diameter than the tappets associated with the exhaust valves.

18. A cylinder head arrangement as set forth in claim 17 wherein the exhaust valve tappets telescopicly receive the upper ends of the exhaust valve springs.

19. A cylinder head arrangement as set forth in claim 14 wherein the coil springs associated with the exhaust valves have a smaller diameter than the tappets associated with the exhaust valves.

20. A cylinder head arrangement as set forth in claim 19 wherein the exhaust valve tappets telescopicly receive the upper ends of the exhaust valve springs.

21. A cylinder head arrangement as set forth in claim 14 wherein the tappets associated with the intake valves are all operated by an intake camshaft and the tappets associated with the exhaust valves are all operated by an exhaust camshaft.

22. A cylinder head arrangement as set forth in claim 21 further including means for driving the camshafts from an output shaft of the engine including an intermediate shaft carried by the cylinder head.

23. A cylinder head arrangement as set forth in claim 22 wherein the exhaust camshaft is disposed further from the plane than the intake camshaft and wherein the intermediate shaft is offset to the same side of the plane as the exhaust camshaft.

24. A cylinder head arrangement as set forth in claim 23 wherein the engine has a pair of cylinder banks, each having a cylinder head assembly as described.

25. A cylinder head arrangement as set forth in claim 24 wherein the cylinder banks are disposed in a V formation.

26. A cylinder head arrangement as set forth in claim 25 wherein the intake camshafts are disposed adjacent the valley of the V and the exhaust camshafts are spaced from the valley of the V.

27. A valve arrangement for a multiple valve arrangement for a multi-valve, overhead valve internal combustion engine comprising a cylinder head defining in part a combustion chamber, a plurality of first poppet valves on one side of said cylinder head, a plurality of second poppet valves on the other side of said cylinder head, one of said plurality of valves comprising intake valves and the other of said plurality of valves comprising exhaust valves, there being more of said first valves than said second valves, a plurality of first coil springs each associated with a respective of said first poppet valves for urging said first poppet valves to their closed position, a plurality of second coil springs each associated with a respective one of said second poppet valves for urging said second poppet valves toward their closed position, a plurality of first tappets each associated with a respective one of said first valves for operating said first valves, and a plurality of second tappets each associated with a respective one of said second valves for operating said second valves, the diameter of said first coil springs being substantially equal to the diameter of said first tappets and the diameter of said second coil springs being substantially smaller than the diameter of said second tappets said second coil springs extending at least in part into said second tappets.

28. A valve arrangement as set forth in claim 27 wherein the distance between the tops of the second tappets and the portion of the cylinder head engaged by the second coil springs is less than the distance between the tops of the first tappets and the surface of the cylinder head engaged by the first coil springs.

29. A valve arrangement as set forth in claim 28 wherein the distance between the tops of the first tappets and the heads of the first valves is approximately equal to the distance between the tops of the second tappets and the heads of the second valves.

30. A valve arrangement as set forth in claim 27 wherein the distance between the tops of the first tappets and the heads of the first valves is approximately equal to the distance between the tops of the second tappets and the heads of the second valves.

31. A valve arrangement as set forth in claim 27 further including a first camshaft for operating said first tappets and said first valves and a second camshaft for operating said second tappets and said second valves, said camshafts lying on opposite sides of a plane passing through the center of said cylinder head.

32. A cylinder head arrangement as set forth in claim 31 further including means for driving the camshafts from an output shaft of the engine including an intermediate shaft carried by the cylinder head.

33. A cylinder head arrangement as set forth in claim 32 wherein the second camshaft is disposed further from the plane than the first camshaft and wherein the intermediate shaft is offset to the same side of the plane as the second camshaft.

34. A cylinder head arrangement as set forth in claim 33 wherein the engine has a pair of cylinder banks, each having a cylinder head assembly as described.

35. A cylinder head arrangement as set forth in claim 34 wherein the cylinder banks are disposed in a V formation.

36. A cylinder head arrangement as set forth in claim 35 wherein the first camshafts are disposed adjacent the valley of the V and the second camshafts are spaced from the valley of the V.

37. A cylinder head assembly for a multiple valve internal combustion cylinder head comprised of a plurality of poppet valves supported for reciprocation by said cylinder head, said cylinder head defining an opening, a single insert received in said opening and having a plurality of bores, a plurality of tappets each received in a respective one of said bores for association with a respective one of said poppet valves for operating said poppet valves.

38. A cylinder head assembly as set forth in claim 37 wherein the insert is formed from a different material than the cylinder head.

39. A cylinder head assembly as set forth in claim 38 wherein the cylinder head is formed from a two piece assembly and wherein the tappet bores and inserts are provided by a cam carrier portion of the cylinder head in which camshafts for operating the tappets are rotatably journalled.

40. A cylinder head assembly as set forth in claim 39 further including port means formed through both of the cylinder head portions for serving the associated cylinder.

41. A cylinder head arrangement for an internal combustion engine comprising a first cylinder head portion defining a combustion chamber and adapted to be affixed to a cylinder block, a second cylinder head portion affixed to said first cylinder head portion and adapted to journal a camshaft, and a gas flow port extending through each of said cylinder head portions for serving said combustion chamber.

42. A valve arrangement for a multiple valve arrangement for a multi-valve, overhead valve internal combustion engine comprising a cylinder head defining in part a combustion chamber, a plurality of first poppet valves on one side of said cylinder head, a plurality of second poppet valves on the other side of said cylinder head, one of said plurality of valves comprising intake valves and the other of said plurality of valves comprising exhaust valves, their being more of said first valves than said second valves, a plurality of first coil springs each associated with a respective of said first poppet valves for urging said first poppet valves to their closed position, a plurality of second coil springs each associated with a respective one of said second poppet valves for urging said second poppet valves toward their closed position, a plurality of first tappets each associated with a respective one of said first valves for operating said first valves, and a plurality of second tappets each associated with a respective one of said second valves for operating said second valves, the diameter of said first coil springs being substantially equal to the diameter of said first tappets and the diameter of said second coil springs being substantially smaller than the diameter of said second tappets, the distance between the tops of said second tappets and the portion of said cylinder head engaged by said second coil springs being less than the distance between the tops of said first tappets and the surface of said cylinder head engaged by said first coil springs.

43. A valve arrangement as set forth in claim 42 wherein the distance between the tops of the first tappets and the heads of the first valves is approximately equal to the distance between the tops of the second tappets and the heads of the second valves.

* * * * *